US011304498B2

(12) United States Patent
Duffus

(10) Patent No.: US 11,304,498 B2
(45) Date of Patent: Apr. 19, 2022

(54) METHOD, SYSTEM AND DEVICE FOR ORGANIZING, STORING, STYLING AND TRANSPORTING MULTIPLE HAIR PIECES

(71) Applicant: Iyabo Moriene Duffus, Brooklyn, NY (US)

(72) Inventor: Iyabo Moriene Duffus, Brooklyn, NY (US)

( * ) Notice: Subject to any disclaimer, the term of this patent is extended or adjusted under 35 U.S.C. 154(b) by 0 days.

(21) Appl. No.: 16/275,498

(22) Filed: Feb. 14, 2019

(65) Prior Publication Data

US 2021/0169202 A1 Jun. 10, 2021

(51) Int. Cl.
*A45D 44/04* (2006.01)
*A47B 45/00* (2006.01)

(52) U.S. Cl.
CPC ..... *A45D 44/04* (2013.01); *A47B 45/00* (2013.01)

(58) Field of Classification Search
CPC ..... A45D 44/04; A45D 44/14; A47B 45/00
See application file for complete search history.

(56) References Cited

U.S. PATENT DOCUMENTS 252,925 A * 1/1882 Browning ..... A47F 7/06 211/33
366,316 A * 7/1887 Haynes ..... A47F 7/06 211/33
493,248 A * 3/1893 Conklin ..... A47F 7/06 211/33
769,478 A * 9/1904 Hanson ..... A47F 7/06 211/33
954,678 A * 4/1910 Justus ..... A47F 7/06 211/33
D67,680 S * 6/1925 Ziegler ..... D6/682.6
1,698,633 A * 1/1929 Jimenez ..... A47G 25/10 223/24
1,746,486 A * 2/1930 Martin ..... A47G 25/10 211/33
1,746,487 A * 2/1930 Martin ..... A47G 25/10 211/33
1,781,822 A * 11/1930 Pohlson ..... A47G 25/10 211/33
1,886,752 A * 11/1932 Stansberry ..... A47F 7/06 211/33
1,928,035 A * 9/1933 Snyder ..... A45D 29/18 132/73.5
1,993,399 A * 3/1935 Cohen ..... A47G 25/10 211/33
2,010,093 A * 8/1935 Lazarus ..... A47G 25/10 211/30
2,094,810 A * 10/1937 Oppenheimer ..... A47F 7/06 211/33
2,291,877 A * 8/1942 Carter ..... A47F 5/04 211/33
2,474,458 A * 6/1949 Beaudoin ..... A45C 11/02 206/9

(Continued)

FOREIGN PATENT DOCUMENTS

DE 2105650 A1 * 8/1972 ..... A45D 44/14

*Primary Examiner* — Stanton L Krycinski

(57) ABSTRACT

A mechanical device used to organize, store, style and transport multiple wigs is disclosed. This device allows for you to store and organize multiple wigs on a space saving device. This device also allows you to adjust devices height to accommodate most hair lengths. This invention allows the user to transport multiple wigs securely.

4 Claims, 9 Drawing Sheets

(56) References Cited

U.S. PATENT DOCUMENTS 2,709,004 A * 5/1955 Dahlstrom ..... A47F 7/06 108/20
3,008,568 A * 11/1961 Van Doren ..... A45C 11/02 206/8
3,503,581 A * 3/1970 Rouleau ..... A45D 44/14 248/121
3,515,318 A * 6/1970 Preble ..... A45D 44/14 223/66
3,552,549 A * 1/1971 Creese ..... A45C 11/00 206/8
3,602,372 A * 8/1971 Verrecchio ..... A47F 7/065 211/100
3,779,433 A * 12/1973 Imai ..... A45D 44/14 223/66
D230,777 S * 3/1974 Imai ..... D28/93
3,820,694 A * 6/1974 Pabis ..... A47F 5/04 223/66
D351,745 S * 10/1994 Seifert ..... D6/682.6
6,112,909 A * 9/2000 Moseley ..... A47F 5/0807 211/30
D538,064 S * 3/2007 Schechter ..... D6/674.1
D624,332 S * 9/2010 Nwatu ..... D6/681.3
7,984,567 B2 * 7/2011 Bertakis ..... A45D 44/18 34/97
D719,769 S * 12/2014 Daniels ..... D6/682.1
8,950,591 B1 * 2/2015 McDowell ..... A45D 44/14 211/13.1
9,427,066 B2 * 8/2016 Davidson ..... A45D 44/14
9,538,831 B1 * 1/2017 Tracy ..... A47F 7/06
D842,549 S * 3/2019 Ndu ..... D28/93
10,219,605 B1 * 3/2019 Love ..... A47B 96/1483
D863,688 S * 10/2019 Ndu ..... D28/93
D911,620 S * 2/2021 Riddick ..... D28/93
2016/0262560 A1 * 9/2016 Fields ..... A47F 7/065

* cited by examiner

METHOD, SYSTEM AND DEVICE FOR ORGANIZING, STORING, STYLING AND TRANSPORTING MULTIPLE HAIR PIECES

CROSS-REFERENCE TO RELATED APPLICATION

This provisional patent application is related to provisional patent application Ser. No. 62/629,230. The contents of that application are incorporated herein by reference.

FIELD OF THE INVENTION

This invention relates to a method, system and device for storing and transporting hairpieces. In particular, this invention relates to a new system for arranging multiple hairpieces on a single device and simultaneously transporting multiple hairpieces on the device. Further, this invention provides that capability to adjust to simultaneously accommodate multiple hairpieces of different lengths.

BACKGROUND

The hair industry is a multiple billion-dollar industry. A substantial segment of this industry includes the use of hairpieces. An increasing number of people use some form of hairpiece. Two more commonly used hairpieces are the toupee for men and the wig for women. These hairpieces can be of natural or synthetic hair or a combination of both. These hairpieces, wigs in particular, can also be of various sizes and lengths. Some women wear long wigs while other women may wear short wigs.

People wear hairpieces for different reasons. One reason for wearing a hairpiece is to address balding or thinning of hair. Women going through medical treatments in many instances may wear a wig due to the fact that the medical treatment causes hair loss. A second reason people wear hairpieces is to the appearance of aging. In addition, sometimes a person may just want to change his or her style or appearance. For example, a woman with short hair may wear a wig hairpiece to give the appearance of person with long hair. The change in one's appearance is one of the primary reasons people wear hairpieces.

It is not unusual for a woman to have multiple wig hairpieces. With multiple hairpieces, one issue that confronts the owner is the proper storage of these hairpieces. Several approaches and products are used to store wig hairpieces. A common product used to storage wigs is the Styrofoam head. This product mimics a human head. This head has a flat base and the owner can place the wig on the head in a manner similar to it a person actually wearing the wig. The Styrofoam head may be the most recognized means to store a wig hairpiece. Similar to the Styrofoam head is the use of a mannequin or mannequin head as a store and holder device for a wig. Some wig owners do not prefer the Styrofoam head because it does not provide sufficient airflow to all parts of the wig.

Therefore, another standard product used to store a wig is a wig stand. This stand can have several designs. The common feature in each design is a base and the surface on which one places the wig. The base provides support for the stand in part to stabilize the stand and keep the stand from toppling over when a wig is placed on it. These wig stands can vary is height because wigs come in various lengths.

Several technological developments have occurred with wig stand devices. U.S. Pat. No. D719,769 is an example of a device with the capability to simultaneously support multiple wig hairpieces. This invention comprises a vertical cylindrical centerpiece attached to a base. Along the vertical centerpiece are multiple holders suitable for holding wig hairpieces or hats. These holders comprise an extension element that extends generally horizontally outward from the centerpiece. Attached to the outward end of the extension element is another generally cylindrical element that extends in a vertical direction. A flat circular disc element is positioned on the holder between the vertical and horizontal elements of the holder. As mentioned several of these holder elements are attached along the vertical centerpiece of the invention.

U.S. Pat. No. D538,064 is another device that has the capability to simultaneously support multiple wig hairpieces. This invention also comprises a vertical cylindrical centerpiece attached to a circular disc typed base. Several curved rod type elements are attached to and extend outward from the vertical base. Attached to the outer end of these curved type rod elements are flat surface elements in the shape of the outline of a person's facial profile.

In addition to the patented wig stand inventions, other products also address the issue of storing wig hairpieces. One product is a multiple hook design for holding several wigs. In this design, hooks are attached to a centerpiece handle. This centerpiece is designed to hang on a door to support the device. Another way to store a wig hairpiece is to place it in a wig bag. A wig case also provides a means store a wig.

Although there are various products designed to store and transport wig hairpieces, these products are cannot effectively accommodate the variety of wig hairpieces one may have. Current wig storing products do not provide the capable for adjustment of the device to accommodate various functions such as styling the wig hairpiece. Devices with the capability to store multiple wig hairpieces cannot adjust to wigs of different sizes and lengths. The difficulty of the user not being able to be mobile with multiple wigs safely from one place to another is an additional challenge. Current wig holders on market do not accommodate long hair wigs and are unable to hold more than one wig at a time. Other wig holders do not offer a secure hold and if moved improperly wig can fall off.

In summary, current wig and hairpiece holder products are not sufficient for anyone who owns more than one wig or hairpiece. The reason is that these current products can hold only one wig or hairpiece at one time. None of these current products can simultaneously hold multiple wigs hairpieces. The current solution is to have multiple wig or hairpiece holders. Owning multiple wig holders is inconvenient due to lack of space saving storage. In addition, wig holders on market now have no adjustable feature to accommodate long wigs.

There remains a need for an improved device and system that enables a person to adjust the device and provide for more efficient storage and transportation of wig and other hairpieces as desired.

SUMMARY

An object of the present invention is to address the problem of a person not being able to have multiple wigs stored together in one space and on one device.

A second object of the present invention is to address the problem of storing and styling wigs on the typical mannequin heads that cannot adjust to the length of the hair.

A third object of the present invention is to address the problem of the user not being able to be mobile with multiple wigs safely from one place to another.

The present invention allows for individual to store and organize multiple wigs on a space saving device. This device also allows a person to adjust the device's height to accommodate most hair lengths. This invention allows the user to transport multiple wigs securely.

The device of the present invention has multiple adjustable extension rods used to store hairpieces. These extension rods attach to a center support. A user can adjust the length of an extension rod and the orientation of the rod. The ability to adjust the various rods of the device will also facilitate the efficient transport of various hairpieces. A circular disc piece attaches to the outer end of a rod. The hairpiece is placed on and secured to the disc.

As stated above, this present invention addresses the problem of not being able to have multiple wigs stored together in one space and on one device. This invention also addresses the problem of storing and styling wigs on the typical mannequin heads that cannot adjust to the length of the hair. This invention addresses the problem of the user not being able to be mobile with multiple wigs safely from one place to another. This invention also allows for an individual to store and organize multiple wigs on a space saving device. This device also allows a user to adjust devices height to accommodate most hair lengths. This invention allows a person to transport multiple wigs securely.

DETAILED DESCRIPTION OF THE INVENTION

Figure 1:
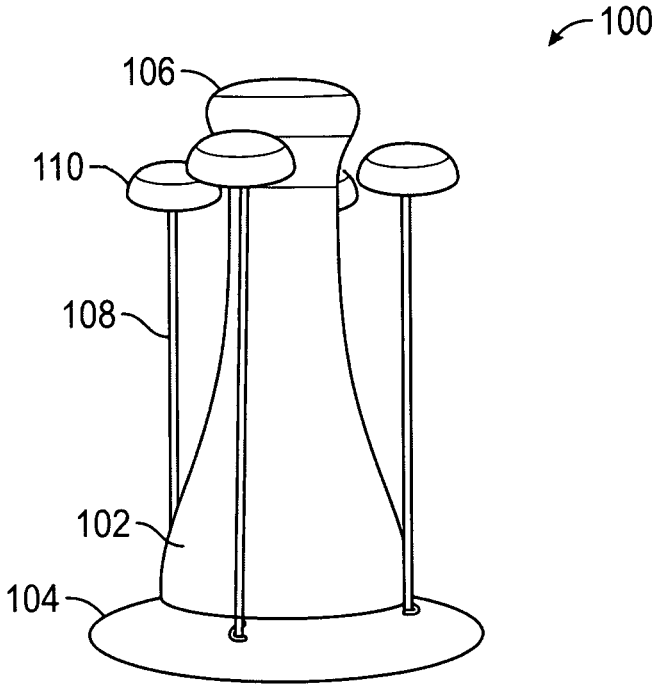
FIG. 1 is a view of a preferred embodiment of the present invention for simultaneously storing and transporting multiple hairpieces.

The description of this present invention interchangeably uses wig and hairpiece to refer to holders. Initially referring to FIG. 1, the device 100 of the present invention can comprise center support structure 102. This center support has a structure that extends in a vertical direction from a base. The ideal height of the center support structure is about one foot. If could extend higher and could be made at various heights. This structure also has a generally cylindrical shape that expands outwardly as it extends downward to the bottom making the bottom of the structure generally wider than the top of the structure 106 by approximately 2 to 3 inches.

The top of the center support has a generally circular outer surface. The bottom base of cylinder structure 104 is a flat round circle approximately 4 inches in diameter circling entire bottom of structure. This part is at the very bottom below the rods. This base has a flat bottom surface and extends outward from the bottom of the center support structure. The outward extended surface of the base offers balance support and aids with weight distribution of the center support structure when supporting multiple wig hairpieces. Attached to the base are multiple extension rods 108. Preferably, there are approximately five-extension rod shaped antenna pieces that are attached to and extend and protrude from the bottom of cylinder base 104. In standard contracted position these rods are approximately 5 inches in height. When these rods are extended (pulled upward) to an elongated position they are 20 to 24 inches in height. At the top of the extension rod shaped antenna pieces are circular shaped 3 dimensional discs 110 that are smooth in texture and are slightly larger than the average fist (approximately 5 to 6 inches). In the center, and at the top of each disc 110 there can be a less than one inch indented groove with a one half inch straight piece 511 above groove. This groove can also serve as clamp for hair. The left and right sides of disc can also have two straight-line pieces less than an inch with the one end facing up. These straight-line pieces can also serve as hair clamps to secure a wig or hairpiece to the disc.

Figure 2:
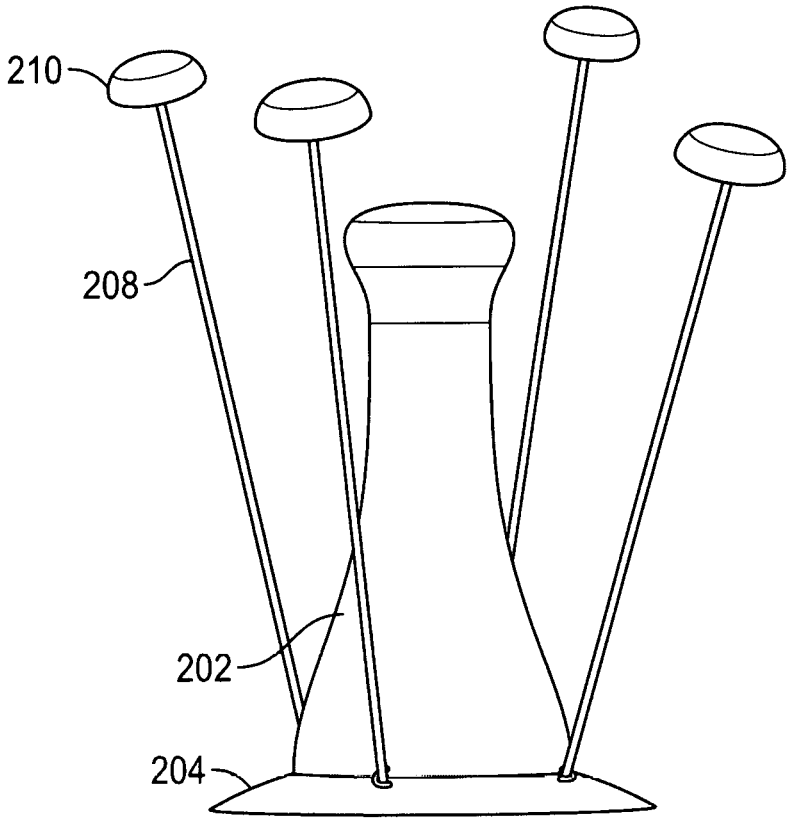
FIG. 2 is a view of a preferred embodiment of the present invention in an expanded configuration.

FIG. 2 is a view of a preferred embodiment of the present invention in an expanded configuration. This view shows the extension rods 208 and discs 210 in an extended position from the center support 202 and base 204. In addition to the capability to extend the rods in a vertical direction, there is also the capability to orientate the rods in outwardly horizontal directions from the center support.

Figure 3:
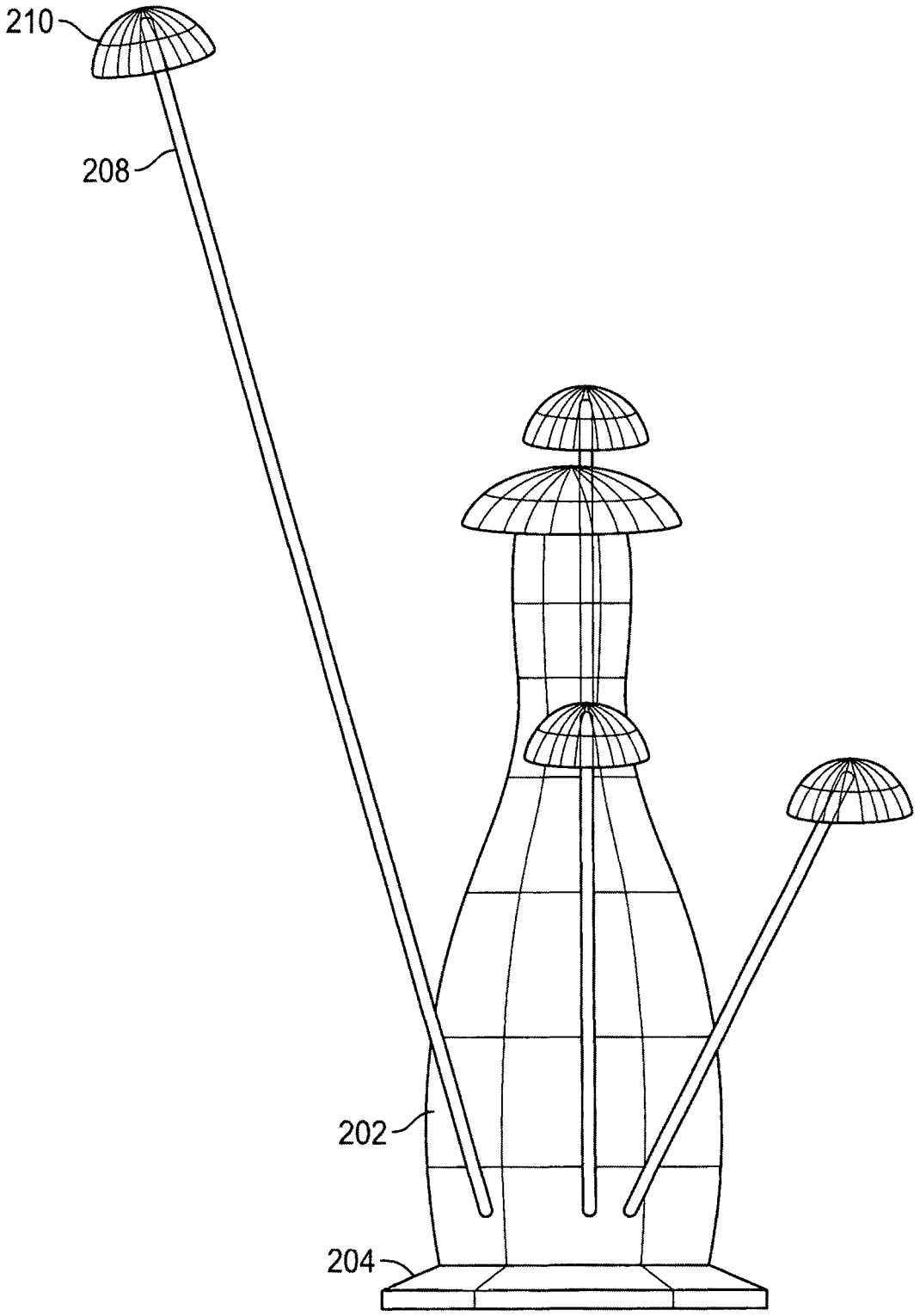
FIG. 3 is a view of a preferred embodiment of the present invention in an alternate expanded configuration.

FIG. 3 is a view of a preferred embodiment of the present invention in an alternate expanded configuration. Shown in this configuration are the extension rods extended at different heights. The extension length for a particular rod would generally depend on the size/length of a particular hairpiece placed on that rod. The extension rod 208 and disc 210 extend far higher than the other extension rods. The other extension rods attached to the central support 202 and base 204.

Figure 4A:
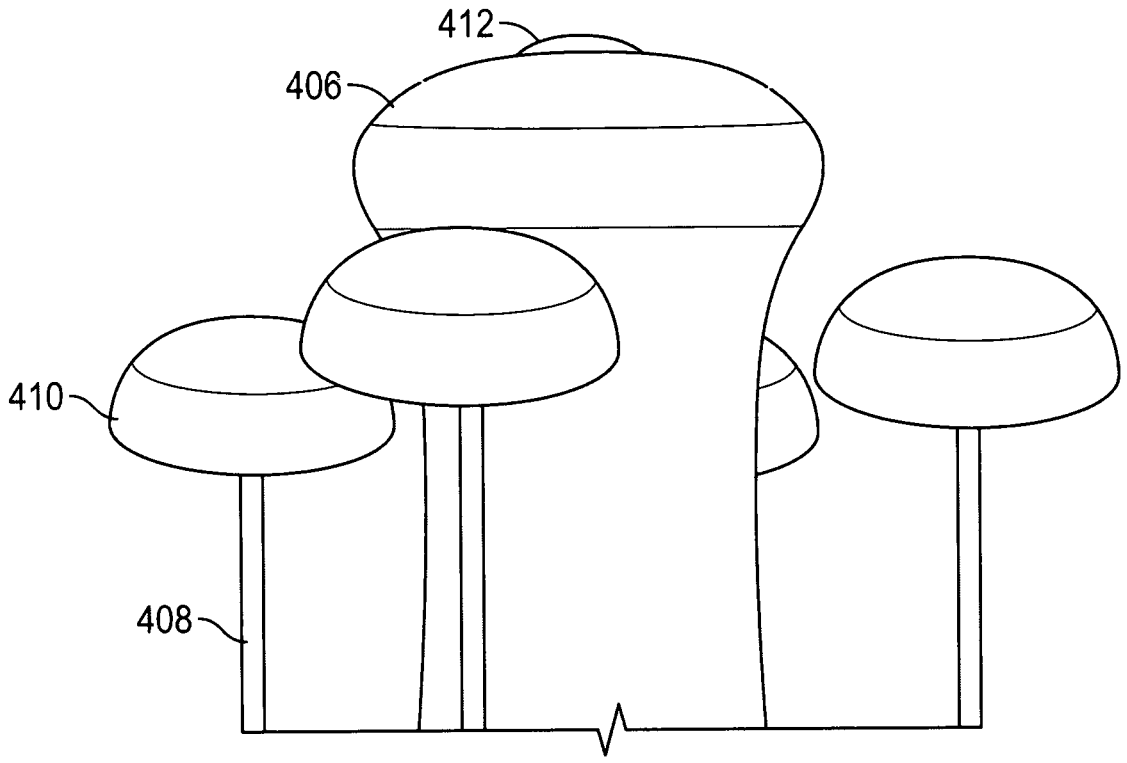
FIG. 4*a* is a broad view of the handle on the top of the center support of the present invention.
Figure 4B:
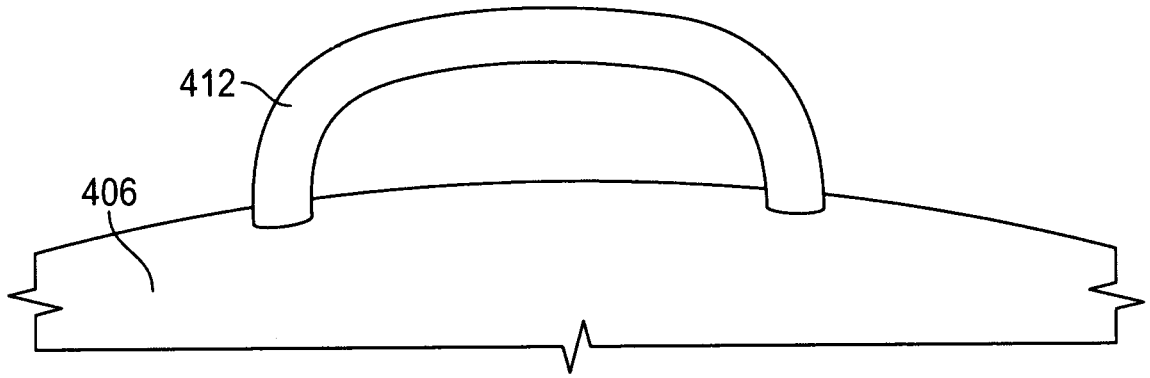
FIG. 4*b* is a view of the handle on top of the center support.

FIGS. 4*a* and 4*b* show the upper portion of the center support and discs and extension rods. FIG. 4*a* is a broad view of the handle on the top of the center support 406 of the present invention and the extension rod 408 and disc 410. Also shown is a handle 412 on the top of the center support. The handle facilitates easier transport of the device of the present invention. When transporting the wigs or hairpieces, the person uses the handle to carry the device. This approach is much easier than the conventional method of hand carrying each wig on a support storage device. FIG. 4*b* is a view of the handle on top of the center support. Shown is a conventional type handle attached to the top surface of the center support. This invention can implement other handle designs as well.

Figure 5A:
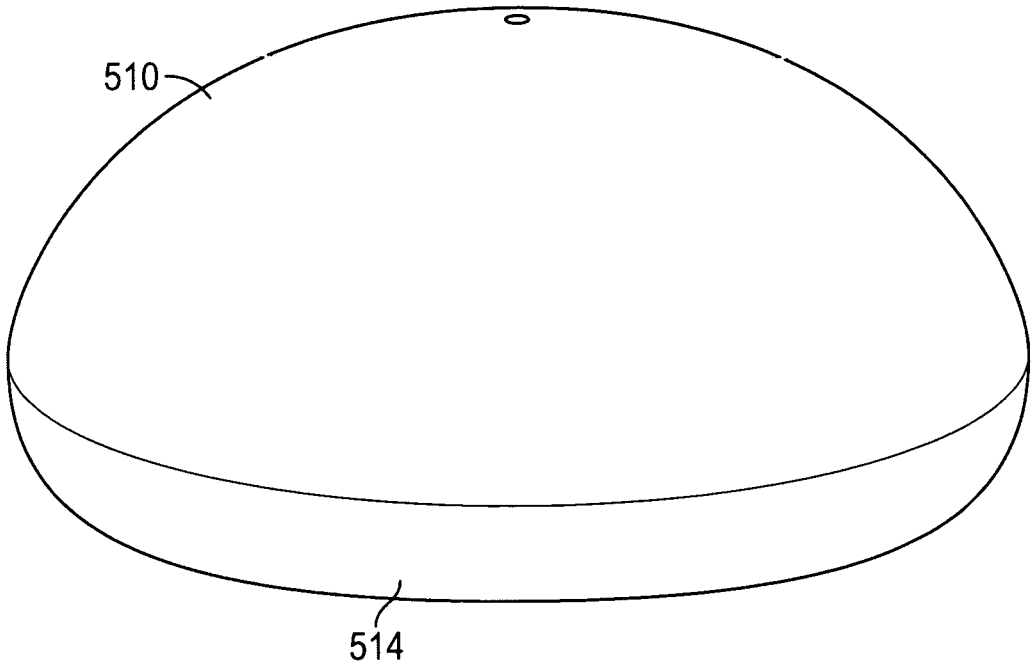
FIG. 5*a* is a view of the disc head of the present invention.

FIG. 5*a* is a view of the disc head 510 of the present invention. As mentioned, this disc head attaches to the top end of the extension rod. The disc has a circular outer surface. The design is a generally shaped semi-circular with a curved top outer surface and a flat bottom surface 514. Not shown under the bottom surface is an opening for attaching the extension rod to the disc. The opening can have threads on its inner wall to enable one to attach the rod via screwing the rod in the disc.

Figure 5B:
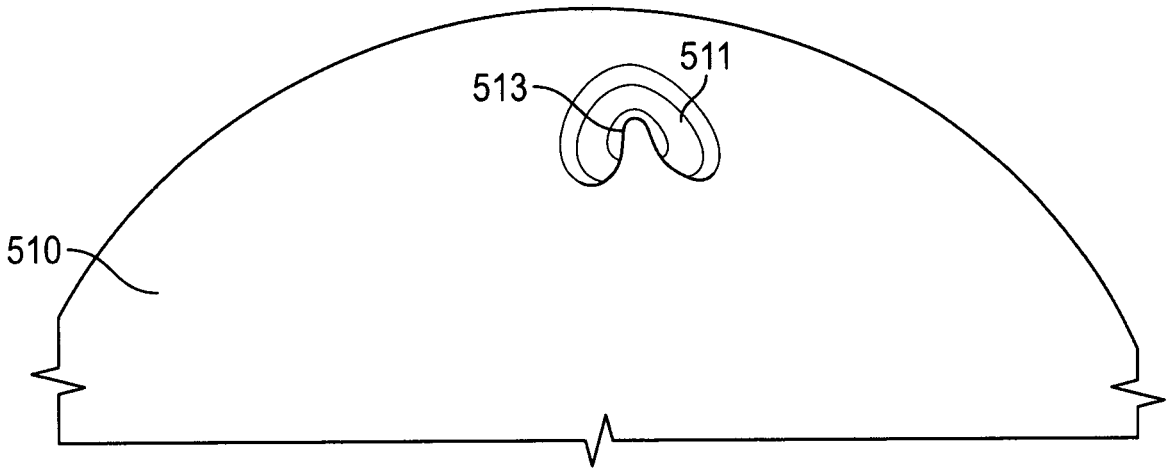
FIG. 5*b* is a top view of the disc head showing a groove for securing a hairpiece to the disc head.

FIG. 5*b* is a top view of the disc head showing a groove for securing a hairpiece to the disc head 510. The groove 511 in the top surface of the disc creates an indention space. Over this indented space can be a hook element 513. In operation, one can slide a hairpiece segment in the open indented space and use the hook to secure the hairpiece to the surface of the disc.

Figure 6:
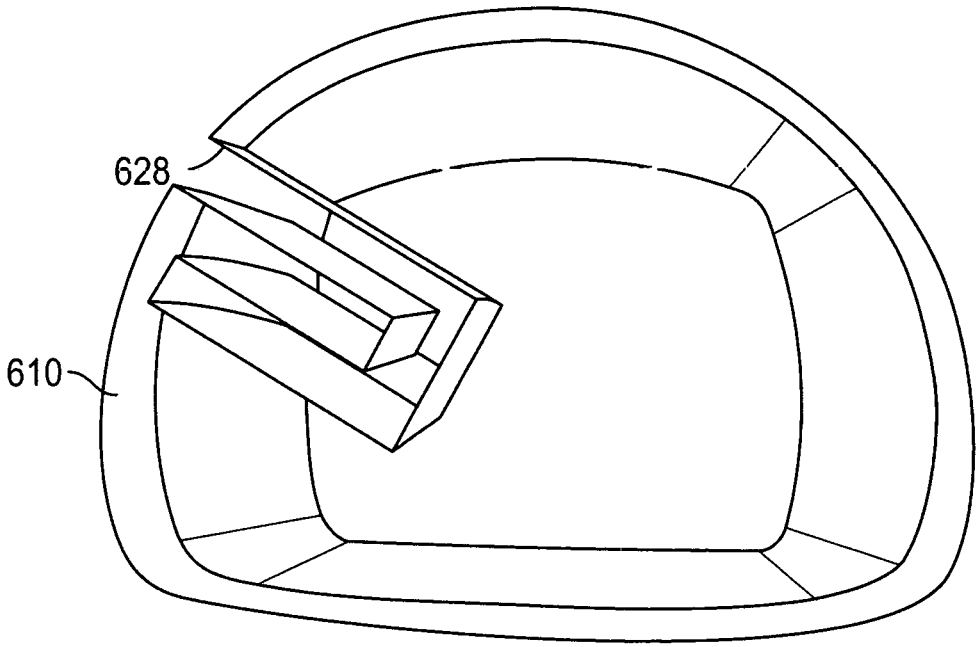
FIG. 6 shows a cross-section view of a clamp insert opening in the disc head.

FIG. 6 shows a cross-section view of a clamp insert opening 628 in the disc head 610. FIG. 5 shows an insertion groove on the top surface. This insertion can 628 can also facilitate the use of an external clamp to secure a wig hairpiece to the disc head. In the implementation, a wig hairpiece would be placed on top of the disc head. The wig could be attached to the disc head with one or more clamps located at the top, left or right sides. The clamps are an option but can provide a secure hold of the wig on the disc head. As mentioned, the disc heads are held up by rod shape bars that are adjustable in height (up/down) to accommodate various hair lengths.

Figure 7:
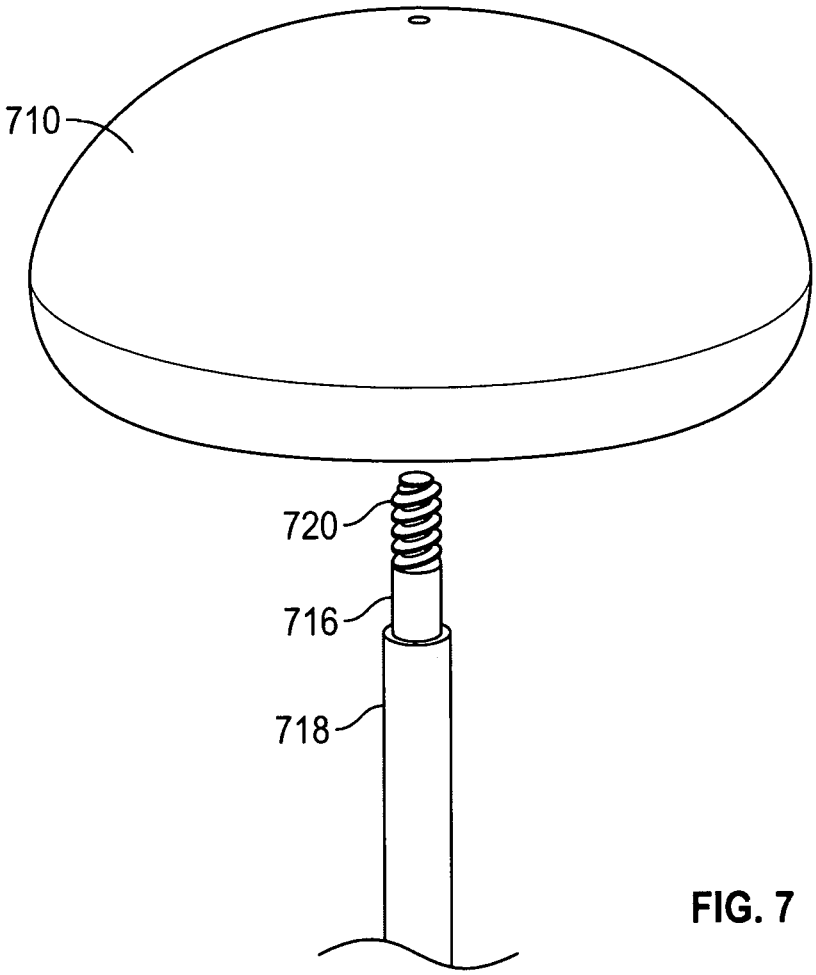
FIG. 7 shows the connection of the disc head and top portion of the extension rod.

FIG. 7 shows the assembly and connection of the disc head and top portion of the extension rod. As mentioned, the disc head 710 has a rounded outer surface and an under surface. The under surface has an opening in which the extension rod inserts to attach the rod and the disc. Further, the extension rod comprises multiple segments. In this FIG. 7, the extension rod shows the two top segments 716 and 718. At the top end of the extension rod segment 716 is a set of threads 720 to engage threads in the opening on the bottom of the disc.

Figure 8A:
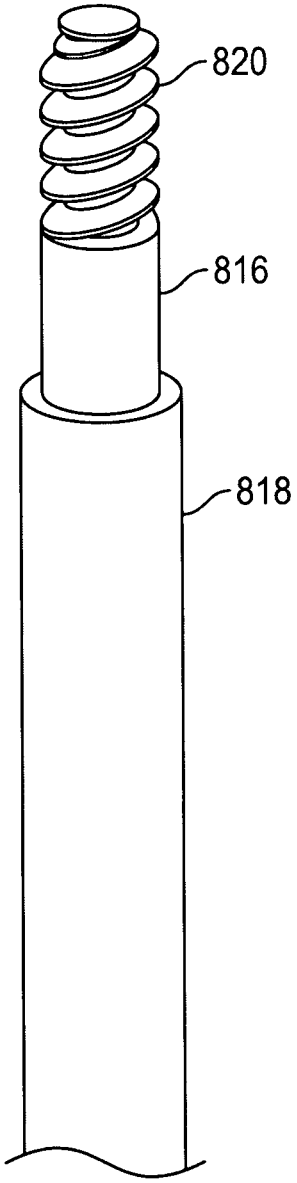
FIG. 8*a* is a view of the extension rod showing the disc head engagement portion and the extension segment.

As previously described, the extension rod comprises several segments. FIG. 8*a* is a view of the extension rod shown in FIG. 7 with two segments 816 and 818. Threads 820 at the end of the extension segment engage and secure the extension rod to the disc.

Figure 8B:
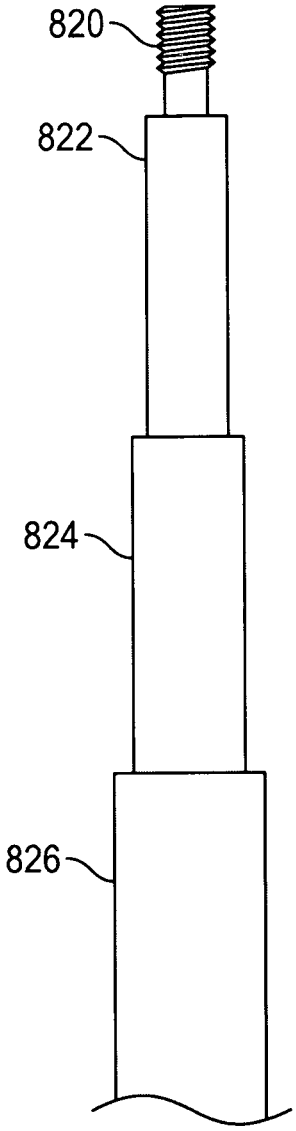
FIG. 8*b* is a view of the extension rod showing the rod in an extended configuration showing multiple rod segments.

FIG. 8*b* is a view of the extension rod showing the rod in an extended configuration showing multiple rod segments. In this configuration of the extension rod, there are several segments 822, 824, and 826. This extension rod is collapsible which enables a user to adjust the length of the rod as needed to store the hairpieces. The adjustment in length is a function of the number of segments extended outward. The segment design for this embodiment of the extension rod is similar to an antenna. In FIG. 8*b*, the rod can be viewed as fully extended. To reduce the length, segment 822 collapses down into segment 824. Each segment has a hollow center. In addition, the outer diameter of segment 822 is slightly smaller than the inner diameter of segment 824, which enables segment 822 to collapse into segment 824. To further reduce the length of the extension rod segment 824 can collapse into segment 826. In addition to the antenna design of the extension rod, other embodiments can be implemented for the design of the extension rod. One alternate embodiment can be where the segments 822, 824 and 826 collapse down by folding the segments.

Figure 9:
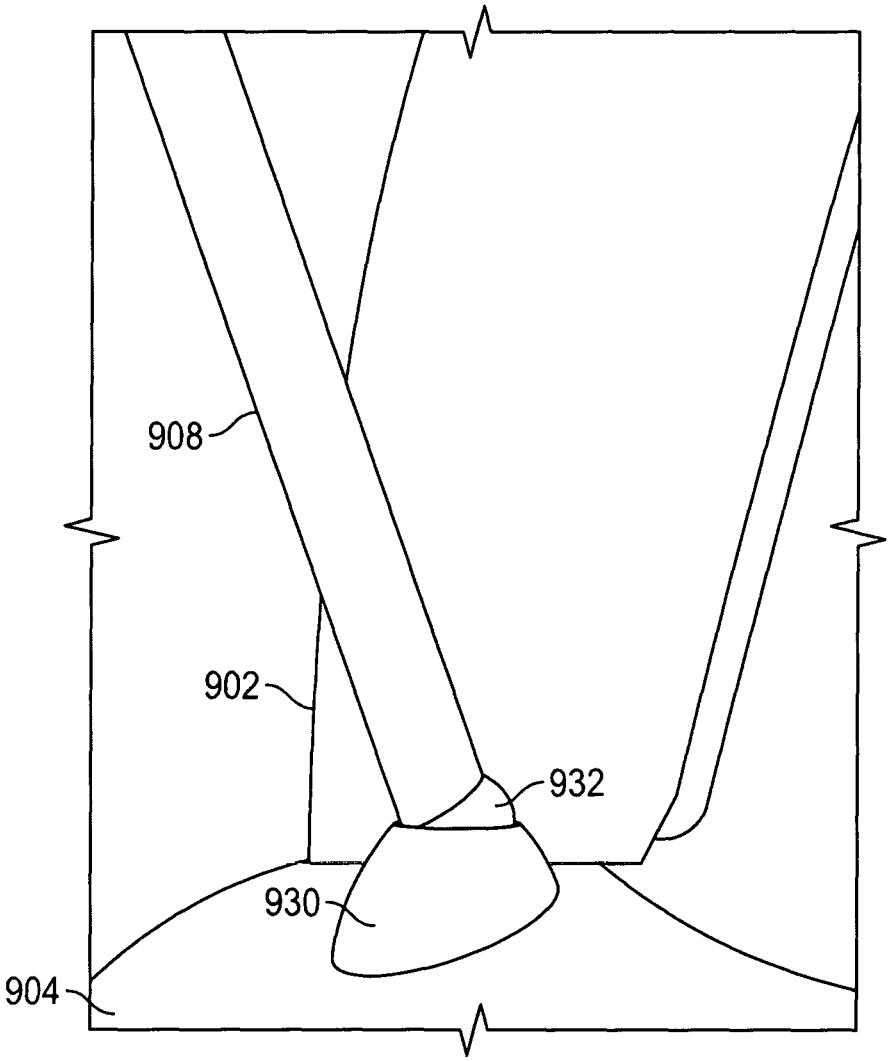
FIG. 9 shows the extension rod attached to the base of the center support.

In addition to having the capability to adjust the length of the extension rod, a user will also have the capability orientate the direction of the extension rod as needed to store the wig hairpieces. FIG. 9 shows the extension rod attached to the base of the center support. The extension rod 908 attaches to the center support 902 and base 904. The rod is attached to the base 904 via a ball joint assemble comprising a base housing 930 and ball joint 932. The ball joint assembly enables the user to rotate and orientate the extension rod a range of degrees in three-dimensional space to further facilitate arranging an extension rod for storing the wig hairpiece.

Figure 10A:
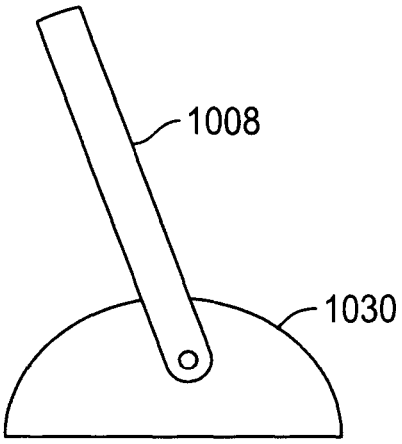
FIGS. 10*a* and 10*b* shows an extension rod connected to a mount to facilitate rod orientation at different orientation degrees.
Figure 10B:
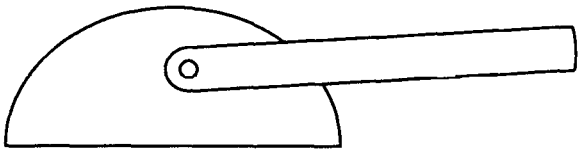

Another embodiment that can facilitate orienting an extension rod is shown in FIGS. 10*a* and 10*b*. In this embodiment, a base 1030 can be rotationally attached to the base. The extension rod 1008 is attached to the base 1030. FIGS. 10*a* and 10*b* show different positions of the extension rod as part of the rod orientation.

Figure 11A:
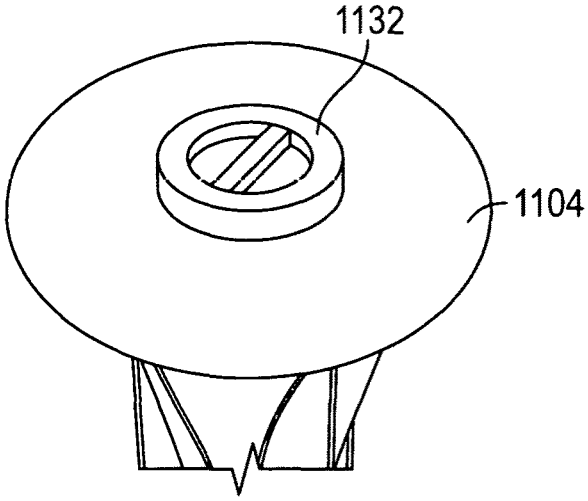
FIGS. 11*a*, 11*b* and 11*c* are views of the bottom of the base of the center support, the opening and plug in the base of the center support and the opening for storing items in the center support.
Figure 11B:
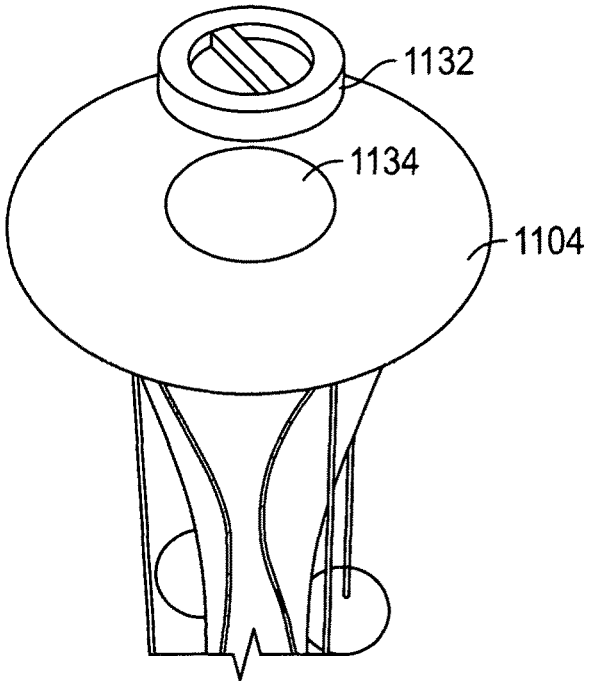
Figure 11C:
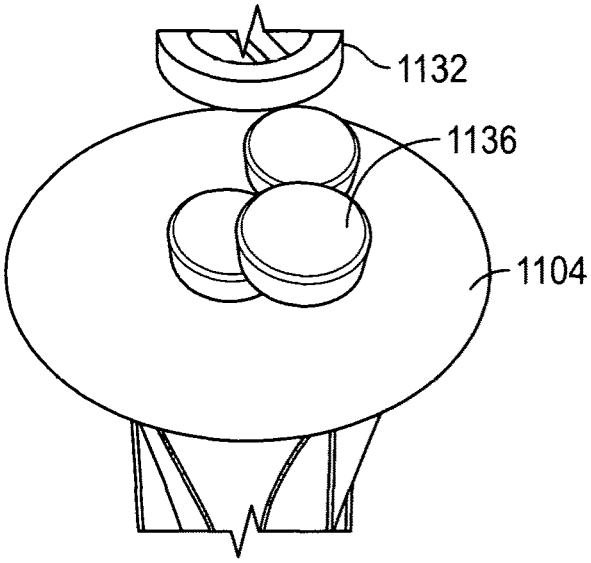

In addition to the other features of the center support, another feature of the center support is a storage channel. FIG. 11*a* is a view of the bottom of the base 1104 of the center support. The bottom of the base can contain a plug element 1132 to cover the plug opening. FIG. 11*b* is a view of the center support opening 1134 and the plug removed from the base of the center support. FIG. 11*c* is a view of the opening for storing items 1136 in the center support. An individual can use this storage space to transport items when transporting the hairpieces.

Figure 12:
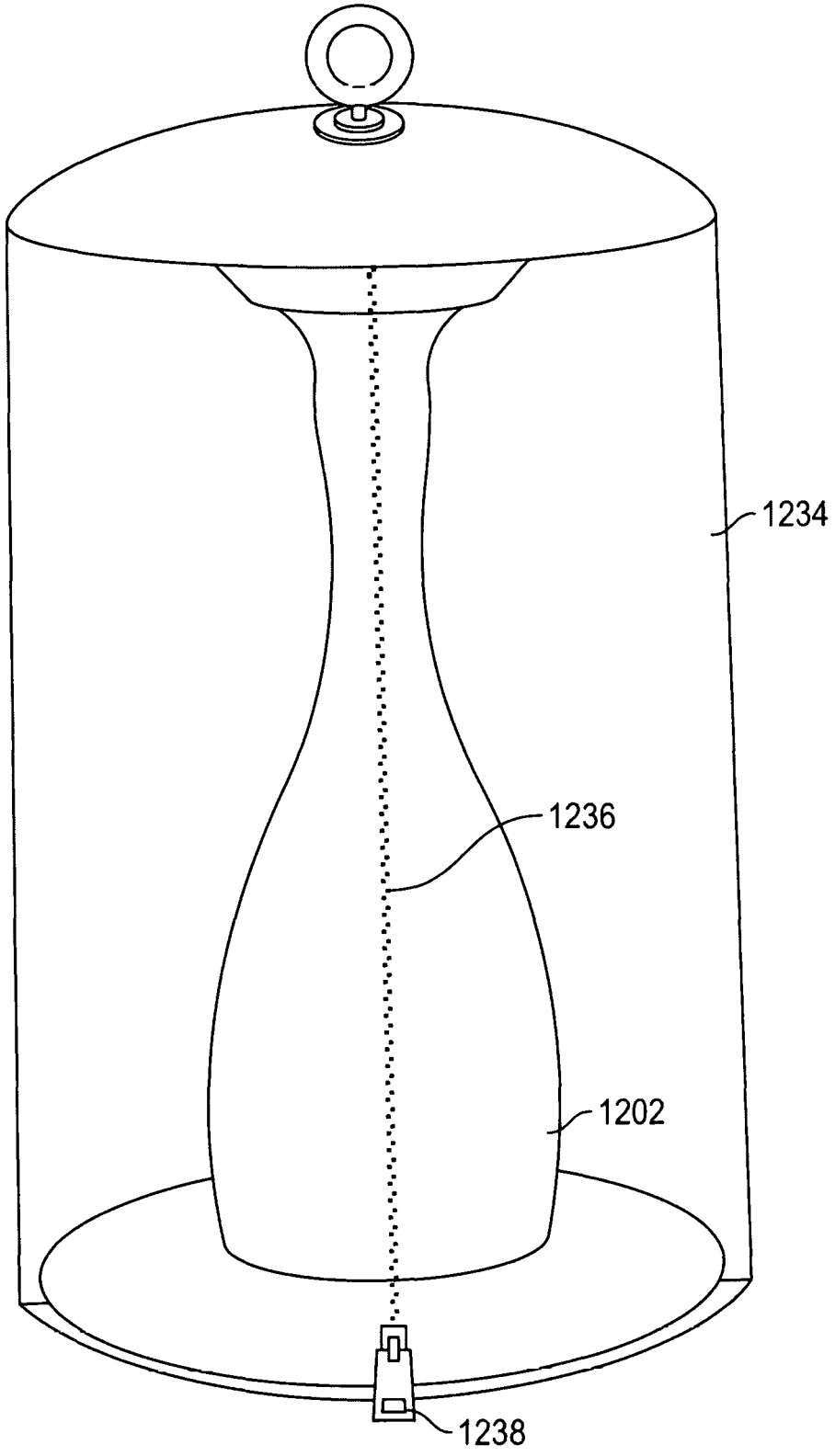
FIG. 12 is a view of the center support of the present invention enclosed for transport.

The present invention can also have an outer cover to enclose the center support and extension rods and disc heads holding wig hairpieces. Referring to FIG. 12 shows the cover enclosing the center support of the invention. The cover 1234 attaches to the top the of the center support 1202 and extends down to the base at the bottom of the structure. This cover has two edges that enable the cover to surround and enclose the center support. These edges attach together 1236 to create the enclosure. A zipper element 1238 provides a means to attach the cover edges to create a seal and enclose the center support structure. The enclosure can be clear and transparent. This enclosure provides additional protection of the wig hairpieces during transport.

To use the device of the present invention, a user would employ a series of steps for efficient storage and transportation of the wig hairpieces. In the initial implementation a user would take steps to properly assemble the device if not previously assemble before the desired use of the device. The assembly may be a straight forward as attaching the disc heads to the extension rods. Once any assembly issues are resolved and the device is ready for use, the user would take a wig hairpiece in hand making sure none of the hair follicles are blocking the wig cap. The user would then place the wig cap on a disc head. The next step is to slide then left and right ends of the wig cap onto wig clips near the area where a person's ears. At this point, one can attach wig clip located at the top center of disc, to wig track. Once hair is secure then the user would adjust rods to height and length of the rod holding wig. The user can also adjust the orientation of the rod based on the size of the wig.

The present invention is a simple design it allows the product to be made via 3D printer, mass production in a manufacturing plant, hand crafted and any other outlet to make images objects. All elements are necessary. Wig clips are optional but are best for a secure hold. Using electricity (battery/outlet) would aid in allowing rods to move up and down automatically instead of pulling them up and down manually. This invention can be modified by changing shapes, adjusting lengths and widths of rods, clips, disc and base to accommodate more wig types, to reduce the amount of space object uses and to make the object more attractive and elegant.

This storage device addresses hair organization issues by allowing hair to be held securely while being mobile or stationary and not interfere with the style of the hair. This device offers the ability to house multiple wigs a once. This invention accommodates different length wigs. The claimed invention differs from currently existing product having a similar objective. No similar invention or product is on market to date. Other means of wig maintenance just consist of human head shaped molds and do not allow for more than one wig at a time and are not adjustable to different hair lengths. This device is better than any wig holder to date because it is able to accommodate multiple wigs at once and adjust too many different hair lengths. This device allows you to transport multiple wigs at once.

This invention is an improvement on what currently exists. There is no similar invention on market to date. Other means of wig maintenance just consist of human head shaped molds and do not allow for more than one wig at a time and are not adjustable to different hair lengths. This device is better than any wig holder to date because it is able to accommodate multiple wigs at once and adjust too many different hair lengths. This device allows you to transport multiple wigs at once.

The method, system and device for organizing, storing, styling and transporting multiple hair pieces of the invention provides significant advantages over the current art. The invention has been described in connection with its preferred embodiments. However, it is not limited thereto. Changes, variations and modifications to the basic design may be made without departing from the inventive concepts in this invention. In addition, these changes, variations and modifications would be obvious to those skilled in the art having the benefit of the foregoing teachings. All such changes, variations and modifications are intended to be within the scope of this invention.

I claim:

1. A method for holding and storing multiple hairpieces simultaneously comprising the steps of:

assembling a hairpiece holder device comprising two or more extension rods each having a bottom end and a top end and said bottom end of each such extension rod being attached to a center support base for supporting the extension rods and with each extension rod's top end having a disc bead secured thereto for supporting hair pieces;

placing a hairpiece on each disc head of one or more of the extension rods attached to the center support base and securing each hairpiece placed on a disc head to said disc head of the extension rod;

adjusting an extension rod length of one of the extension rods attached to the center support base and having a hairpiece secured to the disc head attached to said extension rod, by extending segments of the extension rod connected to a disc head holding a hairpiece in order to achieve balance of the center support base of the hair piece holder device storing multiple hairpieces;

adjusting a direction of an extension rod by orientating the direction of the extension rod attached to the center support base and connected to disc heads securing hairpieces in order to achieve balance of the center support base of the hair piece holder device storing multiple hairpieces;

repeating said adjusting a length of the extension rod and repeating said adjusting a direction for each extension rod and disc head holding a hairpiece to ensure balance of the center support base; and enclosing the center support, extension rods and disc heads for transporting.

2. The method as described in claim 1 further comprising storing elements in a storage opening in the center support.

3. A method for holding, storing and transporting multiple hairpieces simultaneously comprising the steps of:

assembling a hairpiece holder device comprising two or more extension rods each having a bottom end and a top end and said bottom end of each such extension rod being attached to a center support base for supporting the extension rods and with each extension rod's top end having a disc head secured thereto for supporting hair pieces;

placing a hairpiece on each disc head of one or more of the extension rods attached to the center support base and securing each hairpiece placed on a disc head to said disc head of the extension rod;

adjusting an extension rod length of one of the extension rods attached to the center support base and having a hairpiece secured to the disc head attached to said extension rod, by extending segments of the extension rod connected to a disc head holding a hairpiece in order to achieve balance of the center support base of the hair piece holder device storing multiple hairpieces;

adjusting a direction by orientating the direction of an extension rod attached to the center support base and connected to disc heads securing hairpieces in order to achieve balance of the center support base of the hair piece holder device storing multiple hairpieces; and placing a covering over the hair piece holder device and securing the covering to the hair piece holder device for transporting by attaching a bottom edge of the covering to a top edge of the center support base and extending the bottom edge of the covering to a bottom edge of the center support base and placing a covering having two edges over the hairpiece device to enable the covering to completely surround and enclose the center support base over the center support base and using a zipper element on the covering to attach the two edge of the covering and thereby sealing the covering over the center support base, the hair piece holder device containing one or more hair pieces secured inside the cover.

4. The method as described in claim 3 wherein said placing a hairpiece on each disc head further comprising observing hair follicles on wig pieces and preventing hair follicles from blocking a wig cap on the wig piece.

* * * * *